United States Patent [19]

Levenhagen

[11] 4,103,857

[45] Aug. 1, 1978

[54] REINFORCED FIBERGLASS PALLET

[75] Inventor: Alvin W. Levenhagen, Linesville, Pa.

[73] Assignee: Molded Fiber Glass Tray Company, Linesville, Pa.

[21] Appl. No.: 794,665

[22] Filed: May 6, 1977

Related U.S. Application Data

[63] Continuation of Ser. No. 659,467, Feb. 19, 1976, abandoned.

[51] Int. Cl.[2] ..... B65D 19/24

[52] U.S. Cl. ..... 248/346; 108/51.1; 108/901

[58] Field of Search ..... 108/51.1, 52.1, 53.1, 108/53.3, 54.1, 55.1, 55.3, 55.5, 56.1, 57.1; 248/346

[56] References Cited

U.S. PATENT DOCUMENTS

| | | | |
|---|---|---|---|
| 3,298,327 | 1/1967 | Grimes | 108/57.1 |
| 3,330,228 | 7/1967 | Donnelly | 108/51.1 |
| 3,424,110 | 1/1969 | Toot | 108/53.3 |
| 3,511,191 | 5/1970 | Barry, Jr. et al. | 108/901 X |
| 3,630,157 | 12/1971 | Brodragatan | 108/901 X |
| 3,680,495 | 8/1972 | Pike | 108/901 X |
| 3,710,733 | 1/1973 | Story | 108/901 X |
| 3,762,342 | 10/1973 | Lawlor | 108/901 X |

*Primary Examiner*—Roy D. Frazier
*Assistant Examiner*—William E. Lyddane
*Attorney, Agent, or Firm*—Charles L. Lovercheck

[57] ABSTRACT

A pallet made of composite material including thermosetting plastic reinforced with fiberglass forming a platform with integral ribs molded to and extending downwardly from the platform and steel rods molded into the integral ribs at a distance from the section of neutral axis of the cross section of the pallet to make optimum use of the high tensile strength and modulus elasticity of steel, thus providing the required section modulus. The reinforced plastic face serves as the compression side of the beam and provides the required impact resistance from the flat loading surface.

2 Claims, 4 Drawing Figures

REINFORCED FIBERGLASS PALLET

This is a continuation of application Ser. No. 659,467 filed Feb. 19, 1976, now abandoned.

REFERENCE TO PRIOR ART

This patent application constitutes an improvement over U.S. Pat. No. 3,710,733 on an Integrated, Reinforced Plastic Unit and Method and Apparatus for Making Same.

OBJECTS OF THE INVENTION

It is an object of the invention to provide an improved composite pallet.

Another object of the invention is to provide an improved pallet that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Now, with more particular reference to the drawings, the pallet shown in the several figures is integrally molded from a thermo-setting plastic material and reinforced with glass fibers according to techniques and methods familiar to those skilled in the art. The pallet has a flat platform having deep depressions which form ribs. Marginal ribs 12, 13, 14 and 15 are attached to the sides and ends respectively and extending downwardly therefrom. The longitudinal ribs 16 are spaced inwardly from the ribs 12 and 13 and extend parallel thereto and are integrally attached at their ends to the marginal ribs 14 and 15 and extend across the ends of the pallet.

Figure 4:
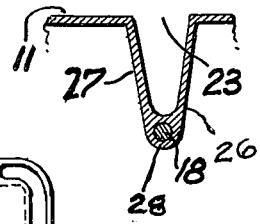
FIG. 4 is an enlarged cross-sectional view taken on line 4—4 of FIG. 3.
Figure 2:
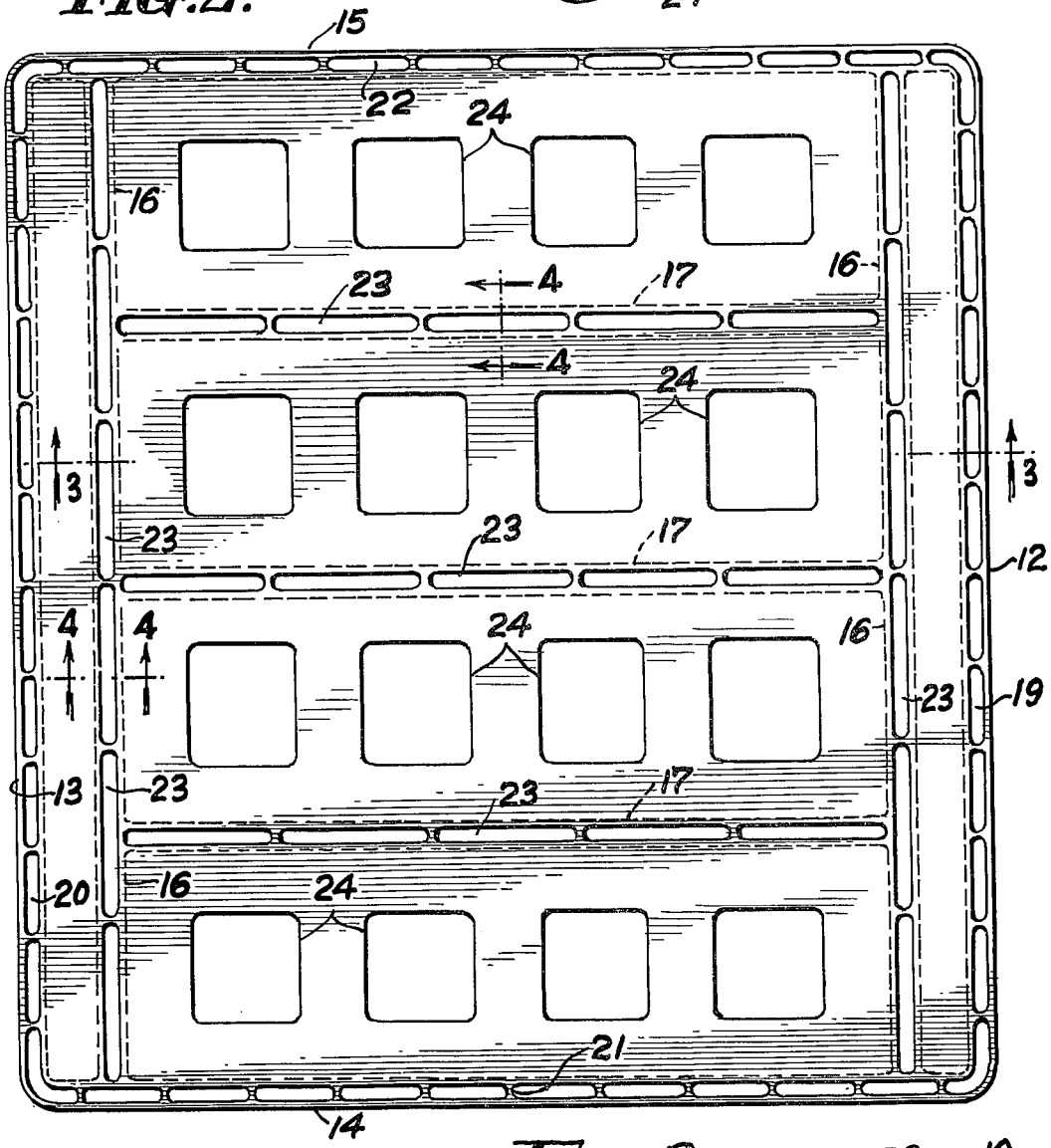
FIG. 2 is a top view of the pallet according to the invention.

The spaced, laterally-extending ribs 17 are equally spaced from each other and from the ends 14 and 15 and are integrally attached at their ends to the ribs 16. The ribs 17 extend parallel to the ends 14 and 15 and are integrally attached at their ends to the ribs 16. All of the ribs are similar in depth and in cross-section. The cross-sectional view shown in FIG. 4 is typical of the ribs 12, 13, 14, 16 and 17. The ribs are all generally U-shaped, having sides 26 and 27 terminating at their lower ends in the apex 28 in which the steel rod 18 is molded therein. The openings 23 are formed in the top of the pallet and are generally oval-shaped as shown and are separated by the spacers 21 which are disposed at intervals along the ribs and prevent the sides 26 and 27 from buckling.

The square holes 24 extend through the platform and are symmetrically arranged across the top of the pallet and are equally spaced from each other and equally spaced from the ribs 14, 15, 16 and 17 as indicated.

The marginal ribs 12, 13, 14 and 15 have a continuous rod 18 in their bottom. Another rod is likewise disposed in the bottom of the ribs 16 at each side of the pallet. The ends of the rods 18 in the rib 16 may be welded to the rod 18 running through the marginal ribs 14 and 15 and the transverse rods in the bottom of ribs 17 may be welded at their ends to the rods in the ribs 16. All of the ribs may have rods in their bottoms which may be welded to the rods which they intersect in the other ribs.

Figure 1:
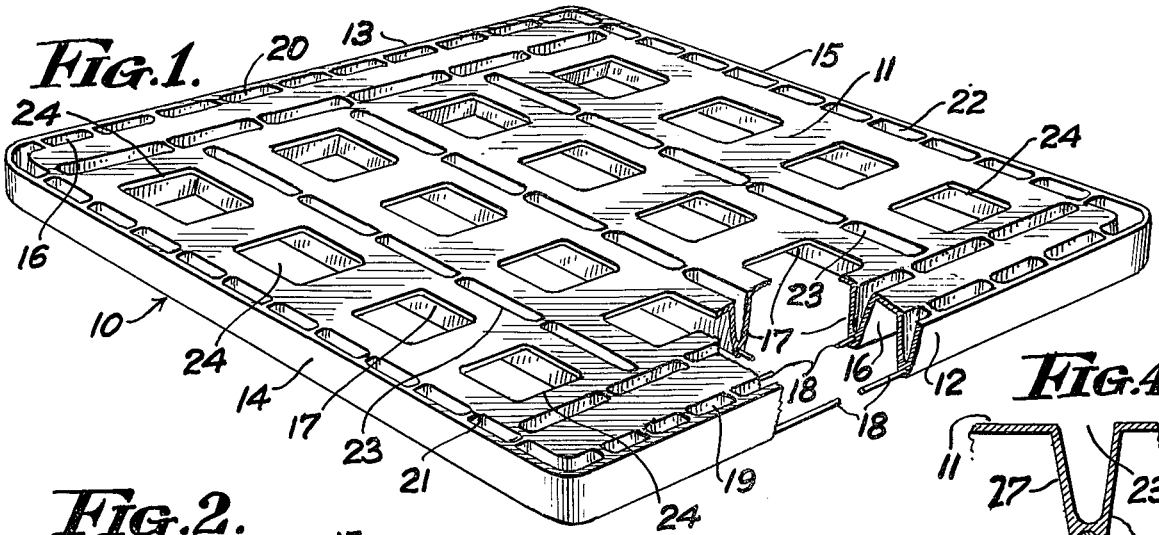
FIG. 1 is an isometric view of the pallet according to the invention.
Figure 3:
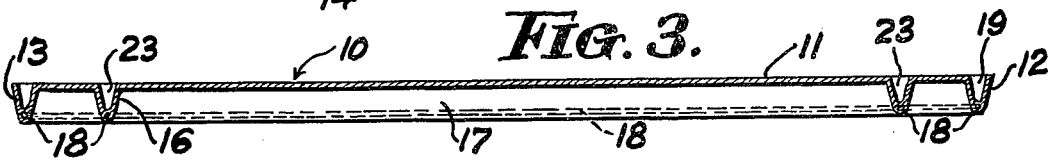
FIG. 3 is a cross-sectional view taken on line 3—3 of FIG. 2.

To make the pallet according to the invention, a framework or reinforcing rods 18 may be made that will provide a rod in the apex 28 of each of the ribs in a grid pattern such as the arrangement of ribs shown. The ribs are made of two plate-like members integrally attached to the platform and converging downwardly toward each other and terminating in a thickened apex portion having a rounded end surface and receiving the rods and providing a matrix for the rods. This grid will be placed in a female mold and the fiberglass and thermosetting resin introduced and the male mold put in place in accordance with good molding practice. The ribs will then be formed with a cross-section such as shown in FIG. 1, 3 and 4.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A rectangular pallet made of a composite thermosetting resin reinforced with glass fiber and steel bars comprising, a rectangular platform having sides and ends made generally of a flat, plate-like member having a generally flat top surface made of thermo-setting resin reinforced with glass fiber, two downwardly extending, spaced marginal first ribs integrally attached to said platform adjacent its sides and two spaced downwardly extending marginal second ribs integrally attached to said platform adjacent its said ends, spaced third ribs extending parallel to said second ribs and attached to said first ribs, each said first rib being integrally attached to a said second rib at a corner of said platform, a grid made of steel rods providing tensile members comprising longitudinally extending first rods and laterally extending second rods and laterally extending third rods, and said ribs being V-shaped in cross-section having plate-like sides integrally attached to said platform at their upper ends and converging downwardly and toward each other and being integrally connected together at their lower end at an externally rounded apex portion substantially thicker than said plate-like side, each of said thickened lower ends providing a matrix receiving one of said rods in the said thickened end portion of each said rib, and spaced webs integrally attached to the sides of said ribs acting as stiffeners for said ribs.

2. The pallet recited in claim 10 wherein said pallet has fourth ribs generally parallel to said first ribs and spaced therefrom, said third ribs and said fourth ribs having an identical configuration to said first ribs and being integrally attached to said pallet.

* * * * *